US009593528B2

(12) United States Patent
Anderson

(10) Patent No.: US 9,593,528 B2
(45) Date of Patent: Mar. 14, 2017

(54) LIGHT BLOCKING ELEMENT FOR A COVERING FOR AN ARCHITECTURAL OPENING

(71) Applicant: Hunter Douglas Inc., Pearl River, NY (US)

(72) Inventor: Richard N. Anderson, Whitesville, KY (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/925,423

(22) Filed: Oct. 28, 2015

(65) Prior Publication Data

US 2016/0123074 A1 May 5, 2016

Related U.S. Application Data

(60) Provisional application No. 62/073,965, filed on Nov. 1, 2014.

(51) Int. Cl.

| | |
|---|---|
| ***E06B 9/38*** | (2006.01) |
| ***E06B 9/262*** | (2006.01) |
| ***E06B 9/323*** | (2006.01) |

(52) U.S. Cl.

CPC ..... *E06B 9/38* (2013.01); *E06B 9/262* (2013.01); *E06B 9/323* (2013.01); *E06B 2009/2627* (2013.01)

(58) Field of Classification Search

CPC . E06B 9/38; E06B 9/388; E06B 9/323; E06B 9/322; E06B 9/262; E06B 9/30; E06B 9/17076; E06B 9/17007; E06B 2009/2627; E06B 2009/17069; E06B 2009/2441

USPC ..... 160/167 R

See application file for complete search history.

(56) References Cited

U.S. PATENT DOCUMENTS

| | | | | |
|---|---|---|---|---|
| 2,412,583 | A * | 12/1946 | Jablin | E06B 9/303 160/168.1 R |
| 7,686,059 | B2 * | 3/2010 | Jarosinski | E06B 9/322 160/167 R |
| 2008/0083508 | A1 | 4/2008 | Rossato | |
| 2009/0014133 | A1 * | 1/2009 | Lin | E06B 9/262 160/181 |
| 2009/0025888 | A1 | 1/2009 | Brace et al. | |
| 2012/0193038 | A1 * | 8/2012 | Corey | E06B 9/262 160/84.05 |
| 2013/0087296 | A1 * | 4/2013 | Mullet | E06B 9/262 160/340 |
| 2013/0160954 | A1 | 6/2013 | Bolton, III | |
| 2016/0123074 | A1 * | 5/2016 | Anderson | E06B 9/38 160/368.1 |

* cited by examiner

*Primary Examiner* — Blair M Johnson

(74) *Attorney, Agent, or Firm* — Dority & Manning, P.A.

(57) ABSTRACT

A light blocking element is movably coupled to and recessed into one of a first rail and a movable rail, and, when the movable rail moves to a position closest to the first rail, the light-blocking element enters into a recess in the other of said first rail and said movable rail and thereby is recessed into both said first rail and said movable rail.

22 Claims, 14 Drawing Sheets

LIGHT BLOCKING ELEMENT FOR A COVERING FOR AN ARCHITECTURAL OPENING

This application claims priority from and is related to U.S. Provisional Application Ser. No. 62/073,965 filed Nov. 1, 2014.

BACKGROUND

The present invention relates to a light-blocking element for a covering for an architectural opening that eliminates the light gap between a first rail and a movable rail.

A typical window blind or shade has an expandable covering material which may be placed at any degree of expansion to cover any portion of the window opening in the vertical or horizontal direction, depending on how the rails are positioned. One configuration includes a movable bottom rail and a movable intermediate rail, with the expandable covering material extending between those two movable rails. In this configuration, the covering material may be retracted by moving the intermediate rail down or by raising the bottom rail up. This is called a Top Down Bottom Up configuration.

A problem in this configuration is that when the intermediate movable rail is moved all the way to the top against the fixed head rail and then released, there may be a slight gap between the intermediate movable rail and the fixed head rail. When back lighted, as in the daytime, this gap is very noticeable and objectionable. Furthermore, the intermediate movable rail may sag in the middle, causing this gap to be variable (greater in the center and less at the ends), which causes the gap to be even more objectionable. Also, the intermediate movable rail may not be perfectly aligned with the fixed head rail; it may be offset or skewed, which also creates a gap.

SUMMARY

An embodiment of the present invention provides a light-blocking element which closes any gap between a movable rail and the fixed head rail when the movable rail is in its uppermost position.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings are for purposes of illustration only, and the dimensions, positions, order, and relative sizes reflected in the drawings attached hereto may vary. The detailed description will be better understood in conjunction with the accompanying drawings, wherein like reference characters represent like elements, as follows.

DESCRIPTION

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and/or serve to distinguish regions of the associated elements from one another, and do not limit the associated element, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

FIGS. 1-6 show a shade 10 with a light-blocking element 12. While the invention is illustrated with respect to a light block at the head rail of a shade 10, it could be used for other types of window coverings for architectural openings, such as for blinds and for vertically-oriented coverings, and it could be used for blocking other light gaps, such as a gap on the side of a blind or shade or other light gaps.

Figure 1:
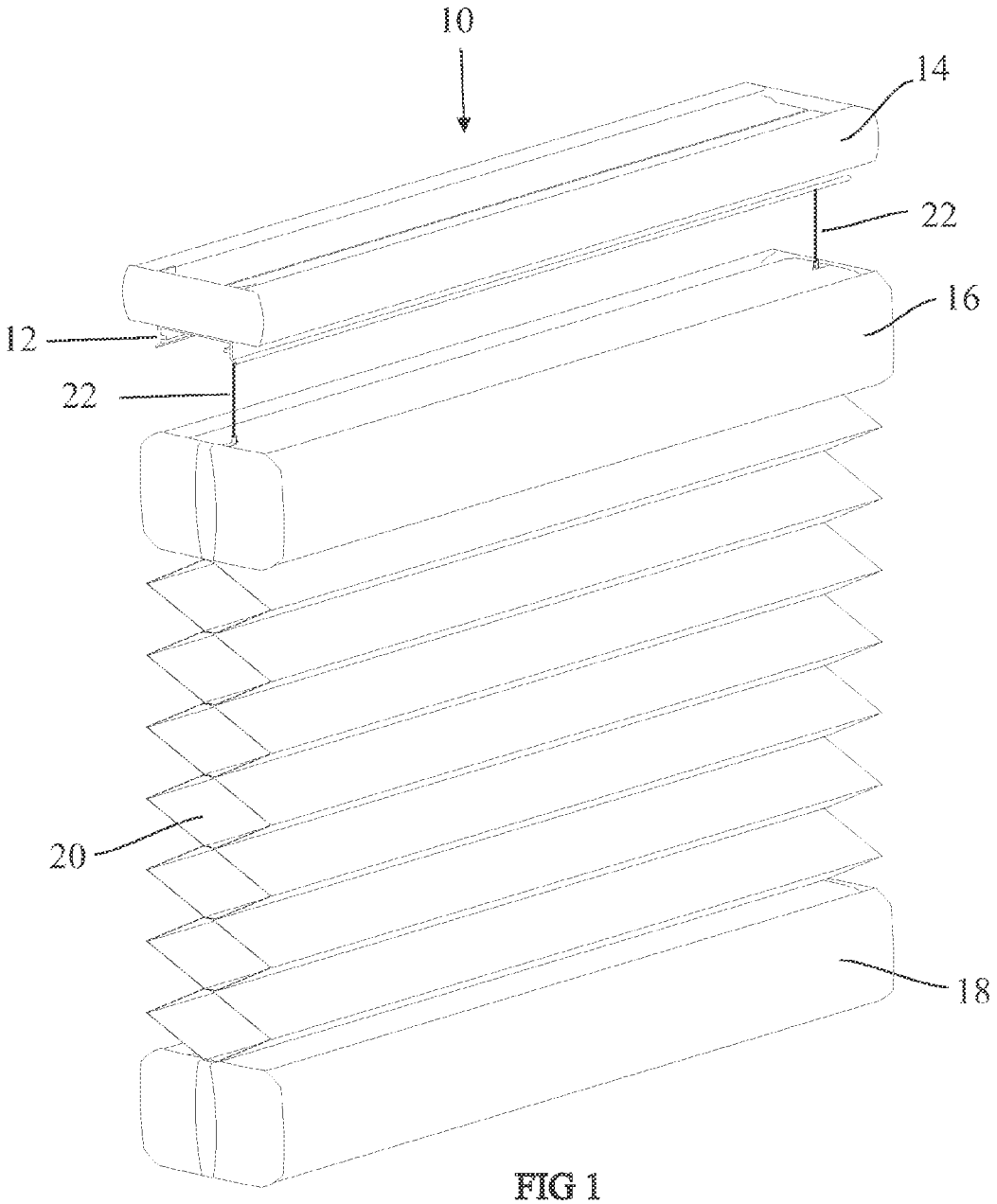
FIG. 1 is a perspective view of a Top Down/Bottom Up (TDBU) shade, with the intermediate movable rail almost, but not quite all the way up against the head rail, and the bottom movable rail all the way down.
Figure 2:
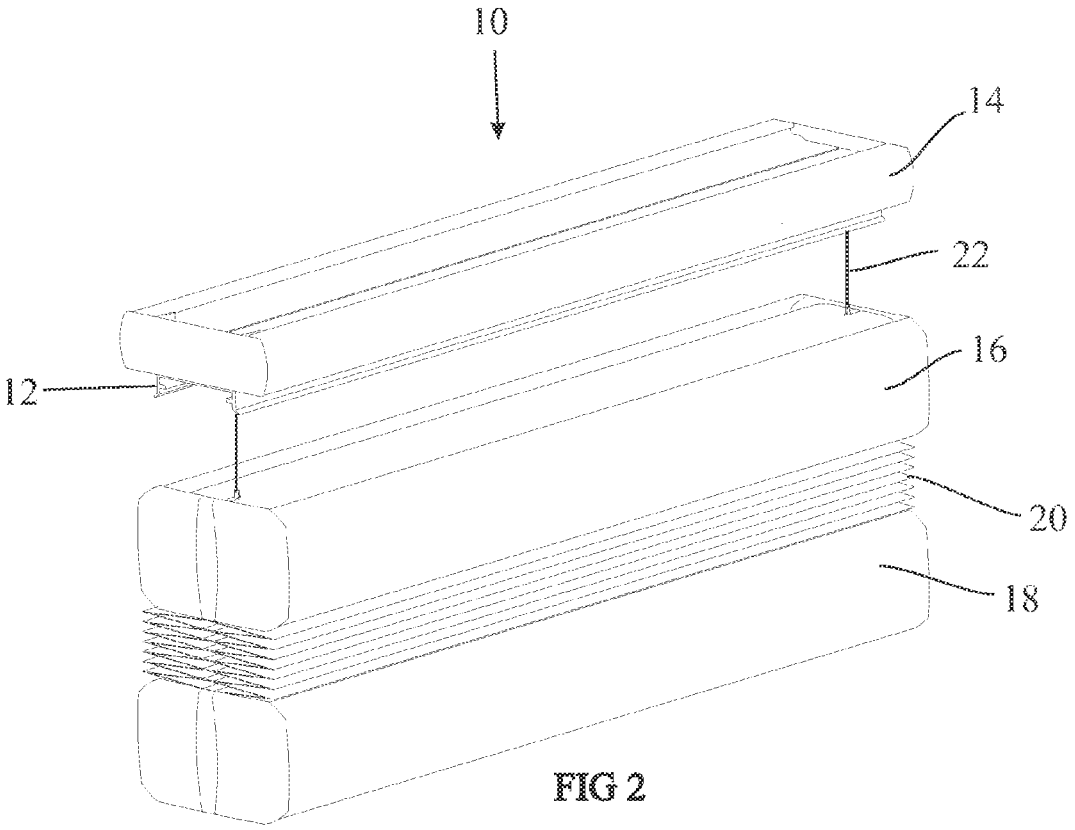
FIG. 2 is a perspective view of the shade of FIG. 1 with the bottom movable rail up as far as it will go relative to the intermediate movable rail.

Referring to FIGS. 1 and 2, the illustrative example of a shade in which the invention may be used is a Top Down/Bottom Up (TDBU) shade 10 with a pleated, cellular covering 20. However, it will be appreciated that the shade 10 may be a Venetian blind or any other type of covering (in contrast with the illustrated pleated, cellular covering) and may have one or more movable rails. The illustrative shade 10 of FIGS. 1 and 2 includes a head rail 14, an intermediate movable rail 16, and a bottom movable rail 18, with an extendable, pleated, cellular covering 20 attached to and extending between the intermediate movable rail 16 and the bottom movable rail 18. In this embodiment, the intermediate movable rail 16 is suspended from the head rail 14 by two lift cords 22. The bottom movable rail 18 is suspended from the intermediate movable rail 16 by at least two lift cords (not shown). Lift cords are used in other embodiments but are not shown for the sake of clarity. It will be appreciated that additional lift cords may be used, but are not necessary.

FIG. 1 shows the shade 10 with the covering 20 expanded between the intermediate movable rail 16 and the bottom movable rail 18, with the intermediate movable rail 16 moved close to the head rail 14 but spaced a short distance apart from the head rail 14. The covering 20 may be refracted by moving the bottom movable rail 18 towards and preferably against the intermediate movable rail 16 as shown in FIG. 2. Alternatively, the covering 20 may be retracted by moving the intermediate movable rail 16 towards the bottom movable rail 18. Of course, other intermediate positions also may be achieved, attaining a partial retraction of the covering 20.

When the intermediate movable rail 16 is moved by the user as far as it will go towards the head rail 14 and then is released, there may be a slight rollback that occurs where the weight of the rail 16 and anything attached to it takes up any slack remaining in the lift cord system by dropping back after any lock (not shown) has engaged the lift rod (not shown). This released position is the uppermost position of the intermediate movable rail 16 (the closest position of the intermediate movable rail 16 to the head rail 14), and the rollback generally creates a slight light gap between the intermediate movable rail 16 and the head rail 14.

The light gap between the movable rail 16 and the head rail 14 may be uniform or non-uniform, and may result from any of a variety of conditions, such as distortion of the head rail 14; distortion of the movable rail 16 (such as may result from suspension of the movable rail 16 from spaced apart lift cords 22, the weight of the movable rail 16 between the lift cords 22 bowing the movable rail 16 downward); and/or skewing of the movable rail 16 with respect to the head rail 14. Because the elongated light-blocking element 12 is movable, as the movable rail 16 is moved towards the head rail 14, the elongated light-blocking element 12 floats with respect to the head rail 14 and the movable rail 16 to accommodate for any gaps between the head rail 14 and the movable rail 16.

Figure 3:
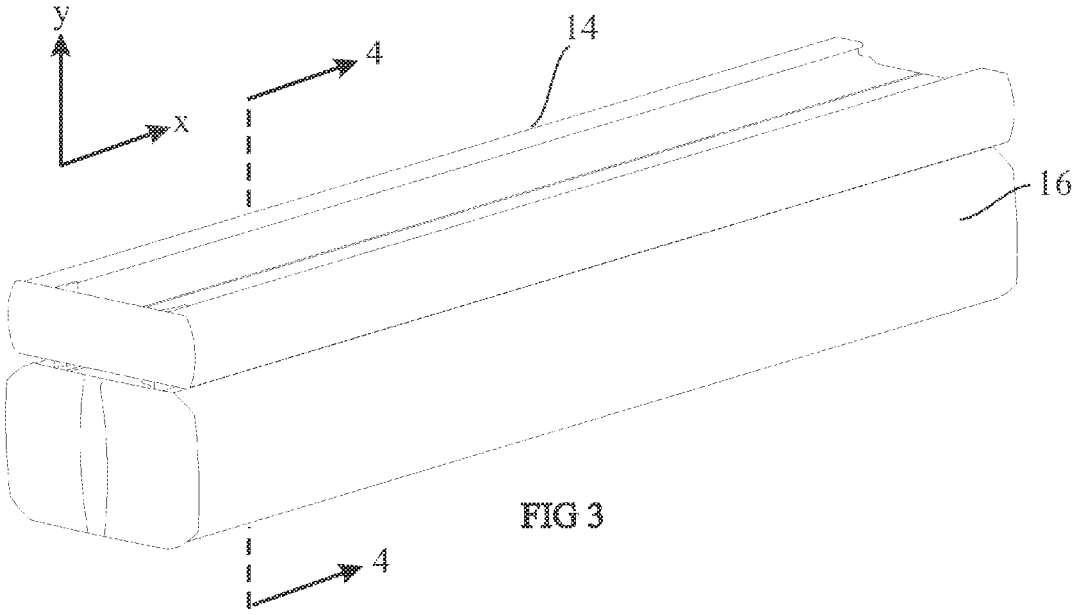
FIG. 3 is a perspective view of the head rail and the intermediate movable rail of the shade of FIG. 1, with the lift cords omitted for clarity, when the intermediate movable rail is in its uppermost position.

FIG. 3 shows the elongated head rail 14 extending in a left-to-right direction (in the x direction), and the intermediate movable rail 16 suspended beneath, and parallel to, the head rail 14. In FIG. 3, the intermediate movable rail 16 is shown in its uppermost position. It is understood that, while the intermediate movable rail 16 is parallel to the head rail 14, there may be some skewing, bowing, or deformation of the intermediate movable rail 16 relative to the head rail 14.

Figure 4:
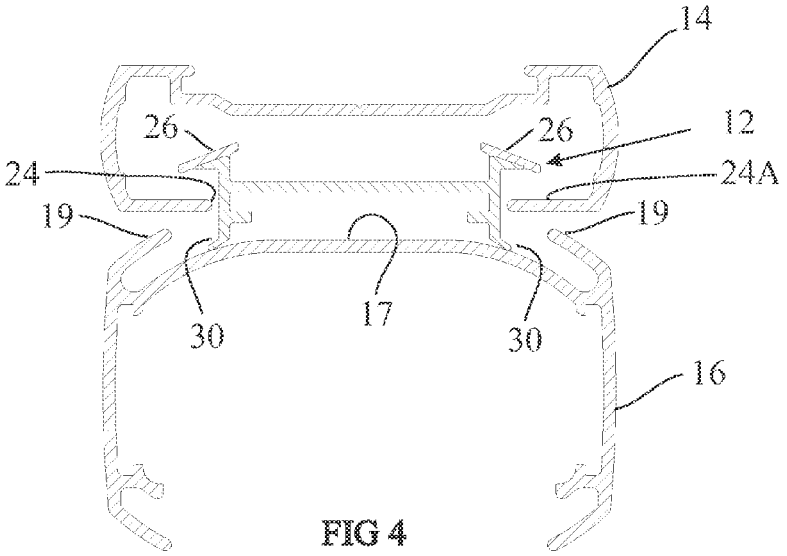
FIG. 4 is a section view along line 4-4 of FIG. 3.

FIG. 4 is a section view taken along line 4-4 of FIG. 3 and shows the head rail 14 with a bottom-facing opening 24, the intermediate movable rail 16, and a light-blocking element 12, which blocks gaps between the head rail 14 and the intermediate movable rail 16. As best appreciated in FIG. 7, which is an exploded, enlarged, section view of the head rail 14 and the light-blocking element 12, the bottom-facing opening 24 is an elongated channel formed by front and rear inwardly-projecting lips 24A at the bottom of the head rail 14 and extends in the left-to-right direction (the x direction of FIG. 3). The elongated light-blocking element 12 also extends in a left-to-right direction and, in this illustrative embodiment, is received in the head rail 14, extending from the left end to the right end of the head rail (See FIG. 6). The light-blocking element 12 defines forward and rear wings 26 located inside the head rail 14 (See FIGS. 4 and 6), a central body portion 28, located beneath the front and rear wings 26, which extends through the elongated bottom-facing opening 24 in the head rail 14, and a lower contact portion 30 which extends below the central body portion 28.

The top surface of the intermediate movable rail 16 has a recessed central portion 17 (See FIG. 4) and upwardly-projecting front and rear edges 19, which terminate at a higher elevation than the recessed central portion 17. When the contact portions 30 of the light block element 12 rest on the recessed central portion 17 of the top surface of the intermediate movable rail 16, there is an overlap in the vertical direction between the edges 19 of the movable rail 16 and the light block element 12, and there is an overlap between the bottom lips 24A of the head rail 14 and the light block element 12. Thus, the light-blocking element 12 is recessed into the top rail 14 and is recessed into the movable rail 16, thereby blocking light from passing through between the head rail 14 and the movable rail 16.

Figure 5:
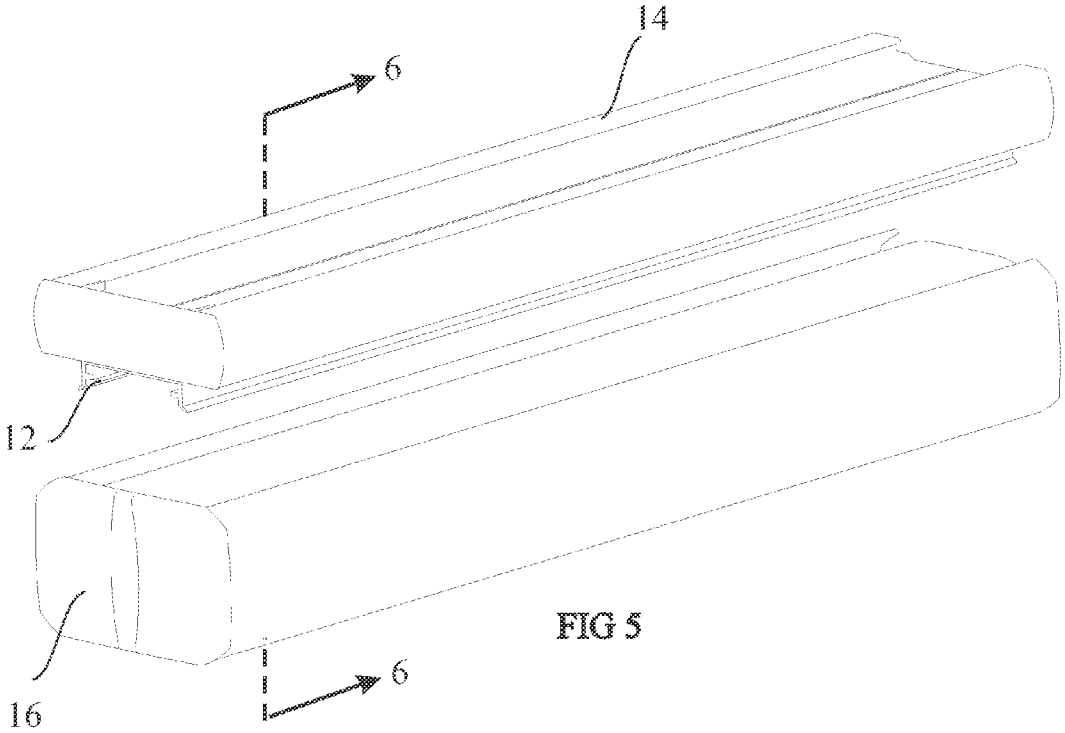
FIG. 5 is a perspective view, similar to FIG. 3, but with the intermediate movable rail lowered and spaced away from the light block element.
Figure 6:
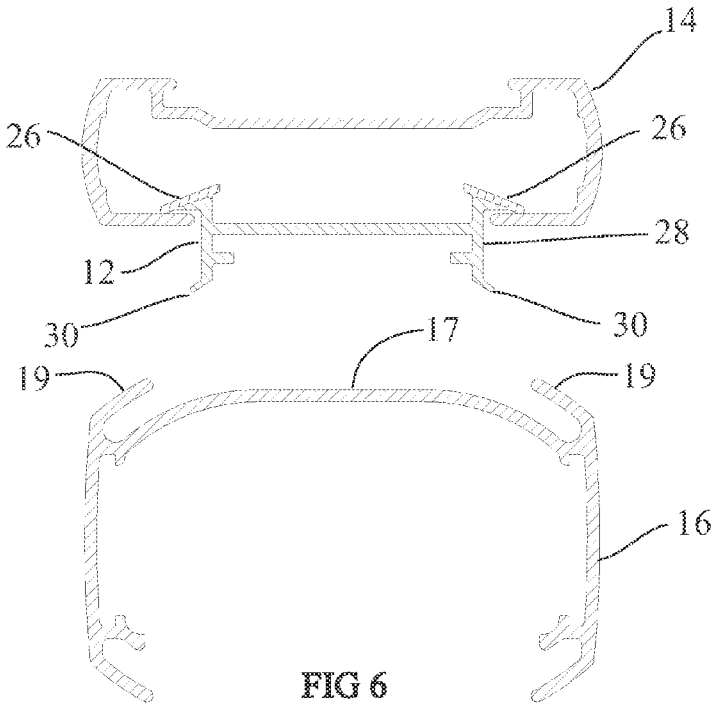
FIG. 6 is a section view along line 6-6 of FIG. 5.
Figure 6A:
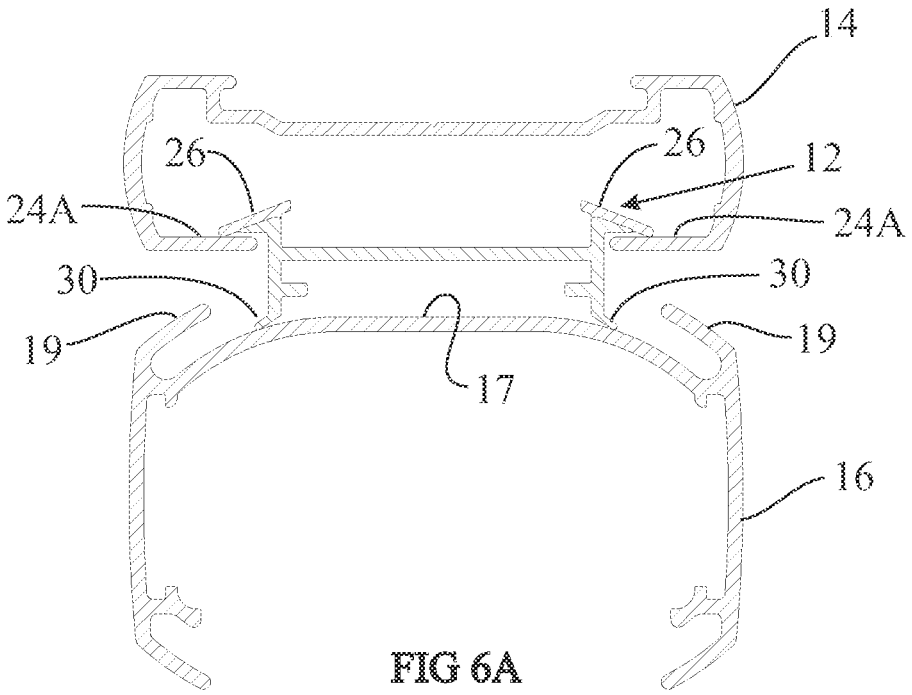
FIG. 6A is similar to FIG. 4 but with the intermediate movable rail lowered until the light block element rests on the head rail.
Figure 7:
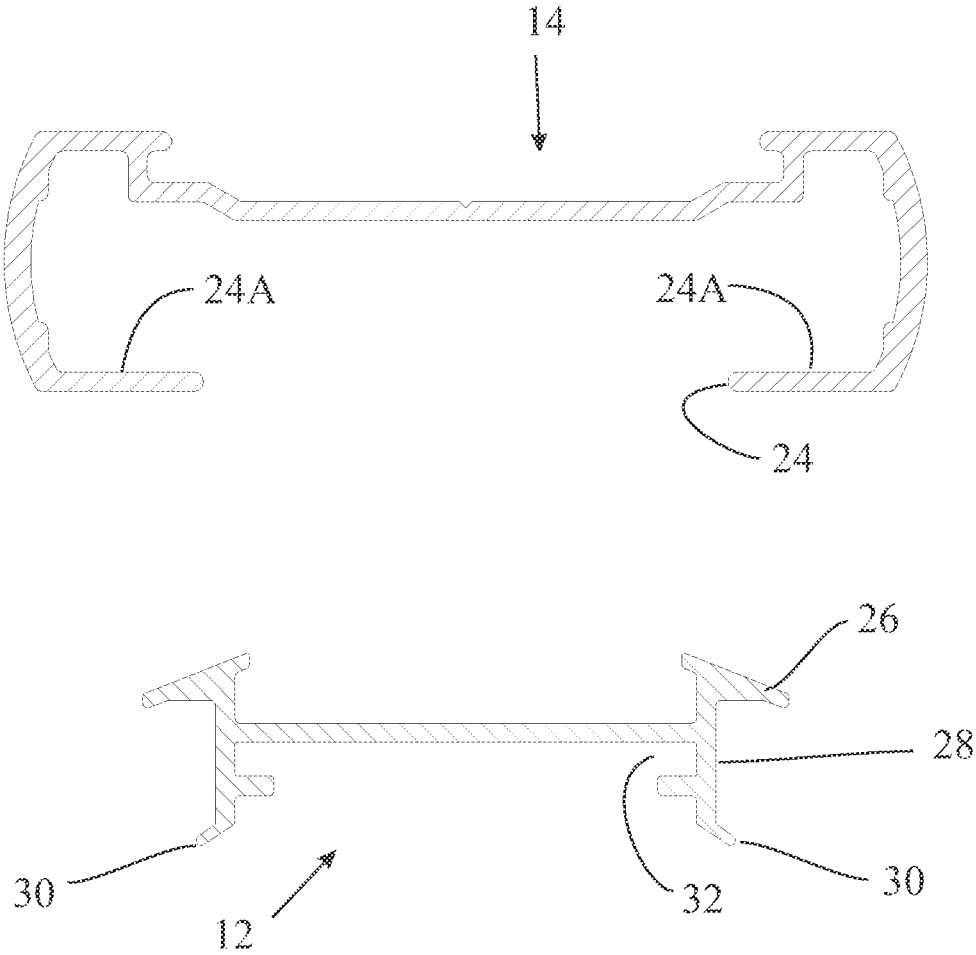
FIG. 7 is an exploded section view of the head rail and light-blocking element of FIG. 6.
Figure 8:
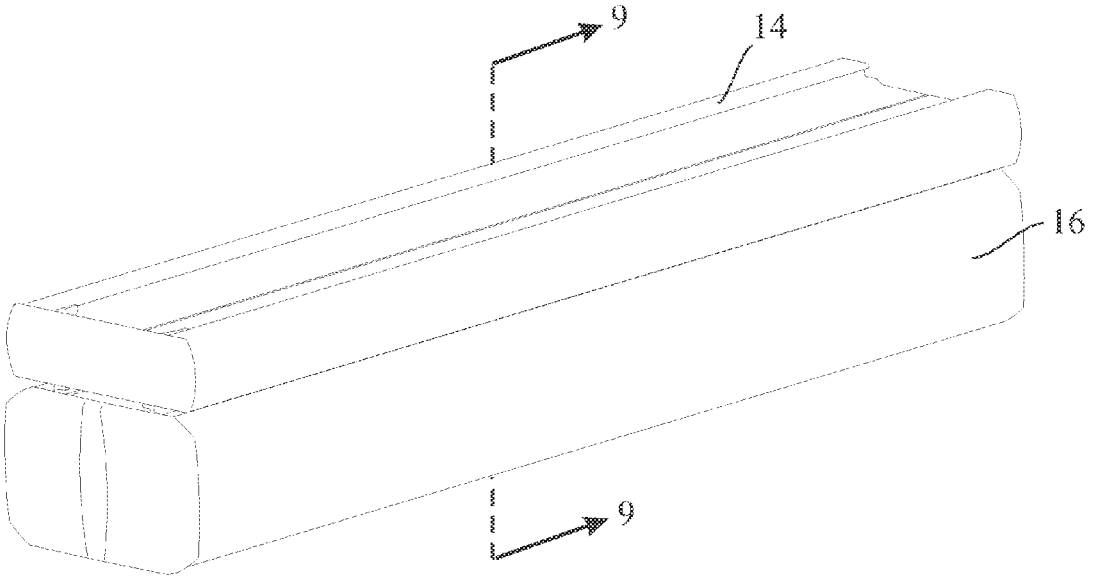
FIG. 8 is a perspective view, similar to FIG. 3, but for another embodiment of a light-blocking element.
Figure 9:
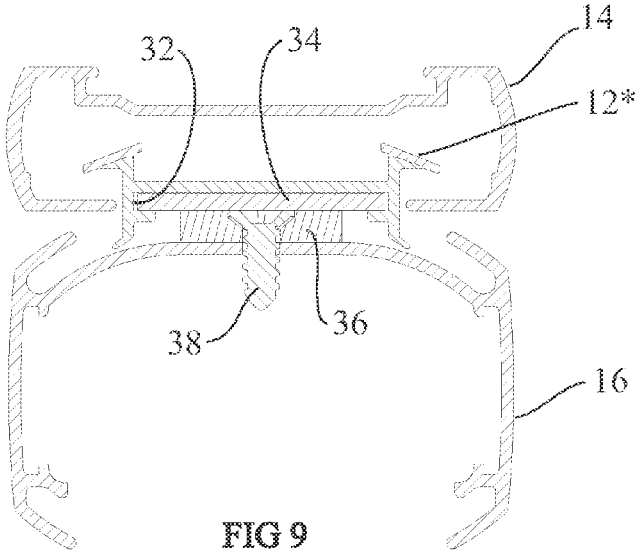
FIG. 9 is a section view along line 9-9 of FIG. 8.

The light-blocking element 12 of the illustrative embodiment of FIGS. 1-21, is movable from a suspended position at a first elevation, in which the light-blocking element 12 is supported by and suspended from the head rail 14, with the front and rear wings 26 of the light-blocking element 12 resting on the inwardly projecting lips 24A at the bottom of the head rail 14, as shown in FIGS. 5 and 6, to a raised position at a second elevation, higher than the first elevation, in which the lower contact portions 30 of the light-blocking element 12 rest on the movable rail 16 so that the movable rail 16 supports the light blocking element 12, as shown in FIGS. 3 and 4. The fact that the front and rear wings 26 extend for a greater front-to-rear distance than the front-to-rear dimension of the channel 24 between the lips 24A ensures that the light-blocking element 12 is retained on the head rail 14 and does not fall out of the head rail 14.

When the intermediate movable rail 16 is in a lowered position, spaced away from the head rail 14, as shown in FIGS. 5 and 6, the light-blocking element 12 is suspended from the head rail 14, with the weight of the light-blocking element 12 being supported by the head rail 14 by means of the front and rear wings 26 resting on the interior surface of the front and rear lips 24A of the head rail 14.

When the intermediate movable rail 16 moves up to a position closest to the head rail 14, as shown in FIGS. 3 and 4, the intermediate movable rail 16 contacts the contact surfaces 30 of the light-blocking element 12 and raises the light-blocking element 12 to a raised position, with the lower contact portion 30 of the light-blocking element 12 resting on the recessed portion 17 of the movable rail 16 so that the movable rail 16 supports the weight of the light blocking element 12. In this raised position, the front and rear wings 26 are spaced above the interior surface of the front and rear lips 24A of the head rail 14 on which they previously rested, so the head rail 14 no longer supports the weight of the light-blocking element 12.

The light-blocking element 12 of the illustrative embodiments of FIGS. 1-21 is movably coupled to the head rail 14, and may be considered to float relative to the head rail 14, depending upon whether the light-blocking element 12 is lifted up by the intermediate movable rail 16 or is resting on and suspended from the head rail 14. When the intermediate movable rail 16 contacts and lifts up the light-blocking element 12, the light-blocking element 12 is recessed into both the head rail 14 and the movable rail, thereby covering any gap between the intermediate movable rail 16 and the head rail 14 to prevent light from shining through the gap.

As an alternative, the light-blocking element 12 could be carried by, retained on, and movably coupled to the movable rail 16. In that case, the top of the movable rail 16 would be shaped similar to the bottom of the top rail 14, with an elongated channel and inwardly facing lips. The light-blocking element 12 would be inverted and its wings 26 would rest on a recessed support surface of the movable rail 16 spaced below the inwardly facing lips, so that the light-blocking element 12 would be carried by the intermediate movable rail 16 and the contact portion 30 of the light-blocking element 12 would project out the open top of the movable rail 16 as the movable rail 16 travels toward and away from the top rail 14. If the intermediate movable rail 16 bows as it carries the weight of the covering, the light-blocking element 12 would remain straight and would float relative to the intermediate movable rail 16 to accommodate any bowing, irregularities, or deflection of the movable rail 16. At least the ends or some portions of the light-blocking element 12 would continue to rest on the support surface of the movable rail 16. If the intermediate movable rail 16 bows enough for the inwardly facing lips to contact the wings 26 of the light-blocking element 12 near the center of the light-blocking element 12, the light-blocking element 12 would also begin to bow. However, even in that case, the light-blocking element 12 would continue to project upwardly from the movable rail 16, and, as the movable rail 16 approaches the top rail 14, the contact portions 30 would enter into the open channel 24 of the top rail 14 so that, when the movable rail 16 is at its position closest to the top rail 14, the light-blocking element 12 would be recessed both inside the top rail 14 and inside the movable rail 16, thereby preventing any light gap between those two rails 14, 16 at that point.

The light-blocking element 12 may be formed from more than one material. For instance, the central body portion 28 of the light-blocking element 12 may be formed from a substantially rigid material, whereas the wings 26 and/or contact portion 30 of the light-blocking element 12 may be formed from a substantially flexible material. In one embodiment, the light-blocking element 12 may be manufactured out of a dual durometer material, such as a hard plastic for the central body portion 28, and a softer, more flexible plastic or rubber for the wings 26 and/or contact portion 30. This results in a quieter operation of the light-blocking element 12 (as a softer element contacts the head rail 14 during movement of the light-blocking element 12, reducing noise upon contact of these elements), and it helps the light-blocking element fill the gap even when the height of the gap varies along the length of the head rail 14, with the more flexible material flexing to adjust for the variations in the height of the gap.

Figure 16:
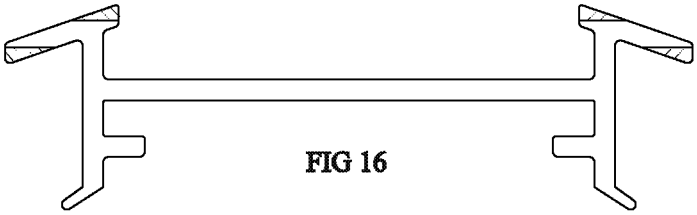
FIG. 16 is a section view of an alternative light block element with softer, more flexible material shown in section at the top and bottom edges of the wings.
Figure 17:
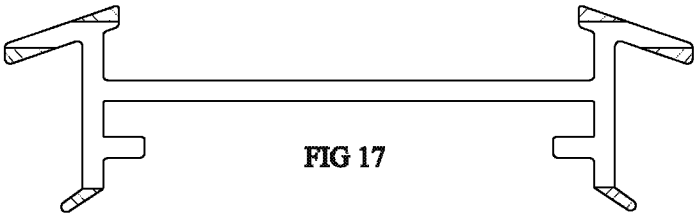
FIG. 17 is a section view of another alternative light block element similar to the light block element of FIG. 16 but also showing softer, more flexible material in section at the lower contact portions.
Figure 18:
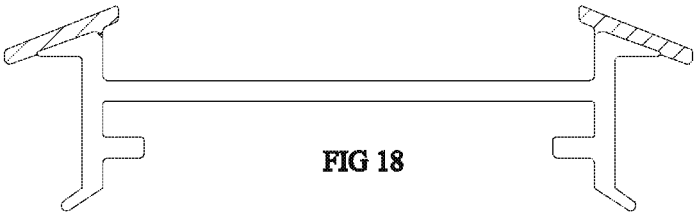
FIG. 18 is a section view of another alternative light block element similar to the light block element of FIG. 16 but with the softer, more flexible material comprising the entire top surface of the wings.
Figure 19:
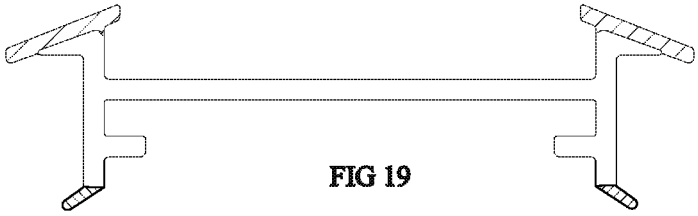
FIG. 19 is a section view of another alternative light block element similar to the light block element of FIG. 18, but also showing softer, more flexible material in section at the lower contact portions.

FIGS. 16 through 19 show various arrangements, with the softer, more flexible material shown in section. In FIG. 16, the more flexible material is located at the top corner and bottom corner of the wings. In FIG. 17, the more flexible material is located as in FIG. 16 and additionally is located at the bottom contact portions. In FIG. 18, the more flexible material is located along the entire top edge of the wings. In FIG. 19, the more flexible material is located as in FIG. 18 and additionally is located at the bottom contact portions.

Figure 10:
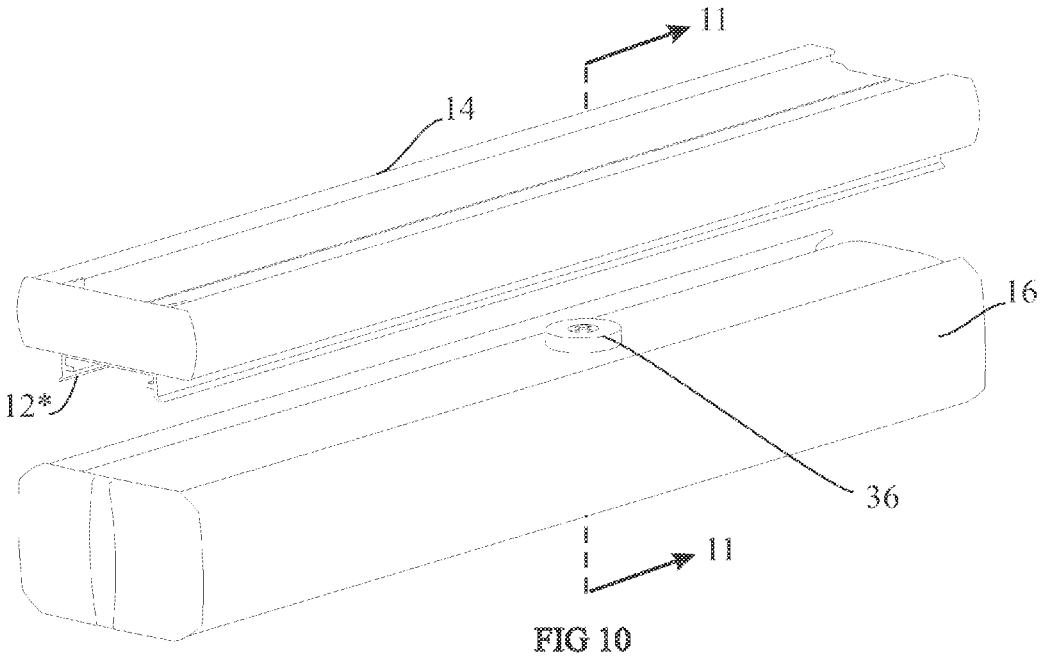
FIG. 10 is a perspective view, similar to FIG. 8, but with the intermediate movable rail almost, but not quite all the way up against the head rail.
Figure 11:
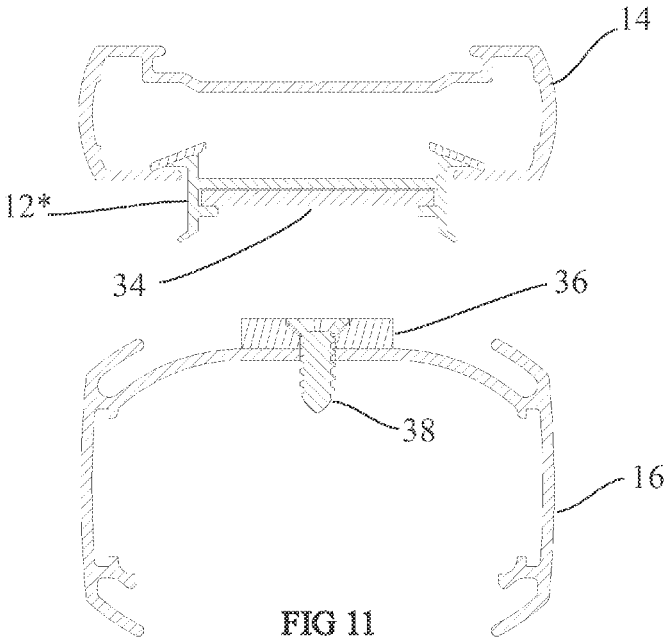
FIG. 11 is a section view along line 11-11 of FIG. 10.
Figure 12:
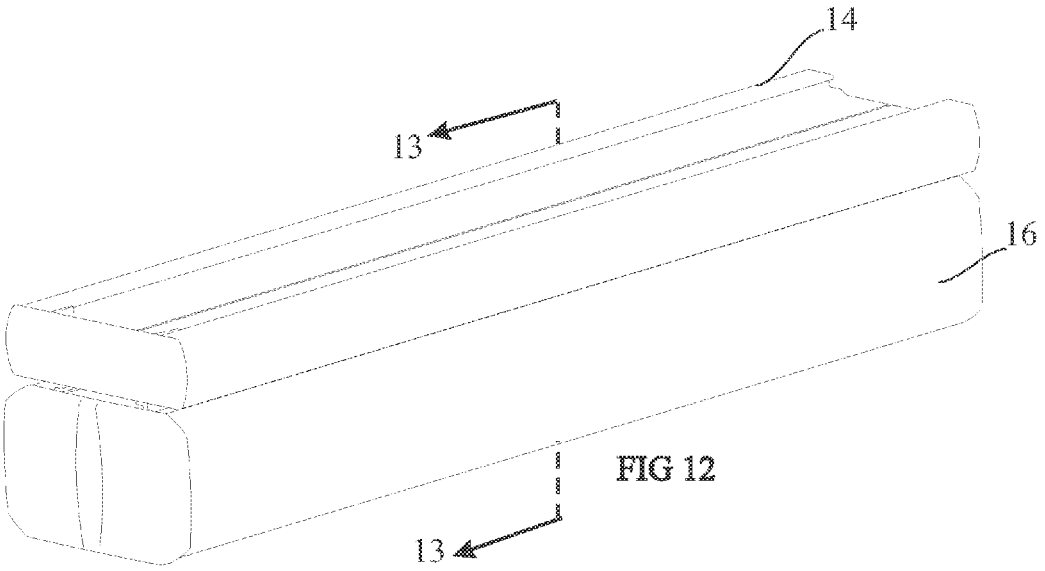
FIG. 12 is a perspective view, similar to FIG. 3, but for another embodiment of a light-blocking element.
Figure 13:
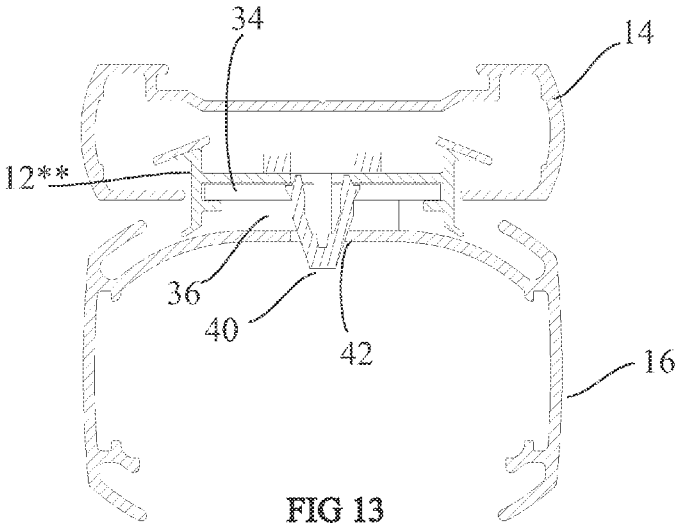
FIG. 13 is a section view along line 13-13 of FIG. 12.
Figure 13A:
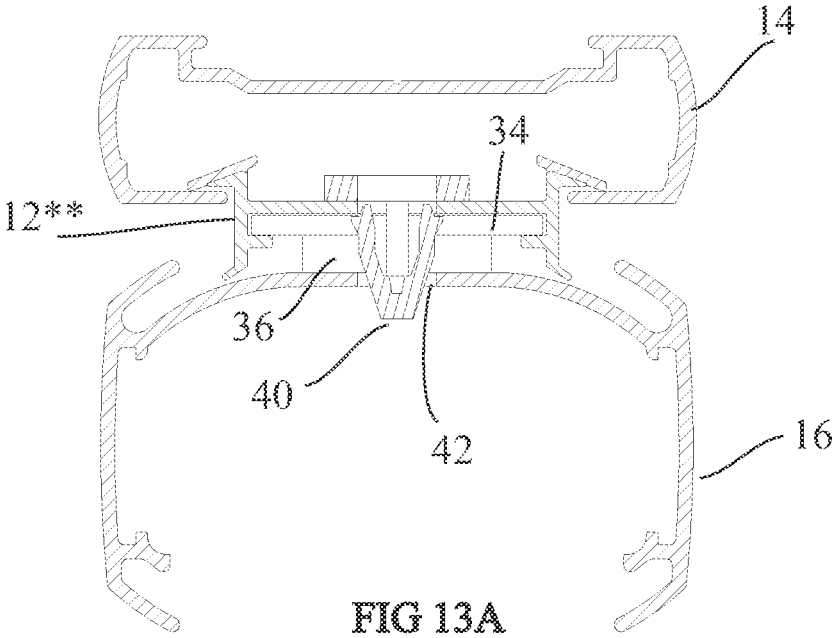
FIG. 13A is the same as FIG. 13 but with the intermediate movable rail lowered until the light blocking element rests on the head rail.

FIGS. 8-11 are similar to FIGS. 3-6 respectively, but show an alternate embodiment of a light-blocking element 12* which uses a magnet to provide additional support for the movable rail 16 to help alleviate any bowing, sagging, deflection, or other distortion of the movable rail 16. This light-blocking element 12* is substantially identical to the light-blocking element 12 of FIG. 7 except that a short, flat strip 34 (See FIG. 11) is inserted and received in a slot 32 (See FIG. 7) of the light-blocking element 12*. The flat strip 34 is made of a ferromagnetic material, such as iron, that is attracted to a magnet. This strip 34 is positioned so as to lie directly above a small magnet 36 attached to the top portion of the intermediate movable rail 16, as best illustrated in FIGS. 10 and 11. The magnet 36 may be secured to the intermediate movable rail 16 by a screw 38 or by any other suitable means, such as by adhering the magnet 36 to the intermediate movable rail 16.

The magnet 36, and the corresponding strip 34 are preferably located towards the middle of an unsupported span of the intermediate movable rail 16, in an effort to prevent undesirable bowing, sagging, deflection or distortion of the intermediate movable rail 16. As the intermediate movable rail 16 is raised all the way up to its uppermost position (See FIG. 8), the magnet 36 on the intermediate movable rail 16 makes contact with the strip 34 on the light-blocking element 12*. The attraction between the strip 34 and the magnet 36 helps provide intermediate support for the intermediate movable rail 16 to minimize bowing, sagging, deflection or distortion.

It should be noted that there may be a plurality of magnets 36 and their corresponding magnetically attracted strips 34 spaced along the longitudinal axis (the x direction) of the head rail 14 and of the intermediate movable rail 16, as desired. Alternately, a single strip of magnetically attracted material may extend substantially the whole length of the light-blocking element 12*, and/or a single magnetic strip may extend substantially the whole length of the intermediate movable rail 16. Finally, the magnet 36 may be mounted to the light-blocking element 12* and the ferromagnetic material 34 may be mounted to the intermediate movable rail 16, or both the strip 34 and the magnet 36 may be magnets, arranged so that their opposite poles face each other so they are attracted to each other.

FIGS. 12-15 are similar to FIGS. 8-11 respectively, but show an alternate embodiment of a light-blocking element 12. This light-blocking element 12** is substantially identical to the light-blocking element 12* of FIG. 11, including having a magnet 36 and a ferromagnetic strip 34 lying just above the magnet 36. In addition, a short, tapered, alignment peg 40 is offset to the right of the magnet 36 and the strip 34. The peg 40 projects from the bottom of the light-blocking element 12** and is received in a corresponding opening 42 on the top portion of the intermediate movable rail 16. In the previous embodiment, as the user raises the intermediate movable rail 16 up against the head rail 14, the alignment between the movable rail 16 and the light-blocking element 12* may be off, and once the magnet(s) 36 grab, it becomes difficult to realign the parts. The tapered peg 40 and opening 42 of this embodiment serve as a guide, with the tapered peg 40 entering the opening 42 as the movable rail 16 approaches the head rail 14, to ensure that the rails 14, 16 are properly aligned as they are brought together and before the magnet 36 secures the light-blocking element 12** and the rail 16** together.

Figure 14:
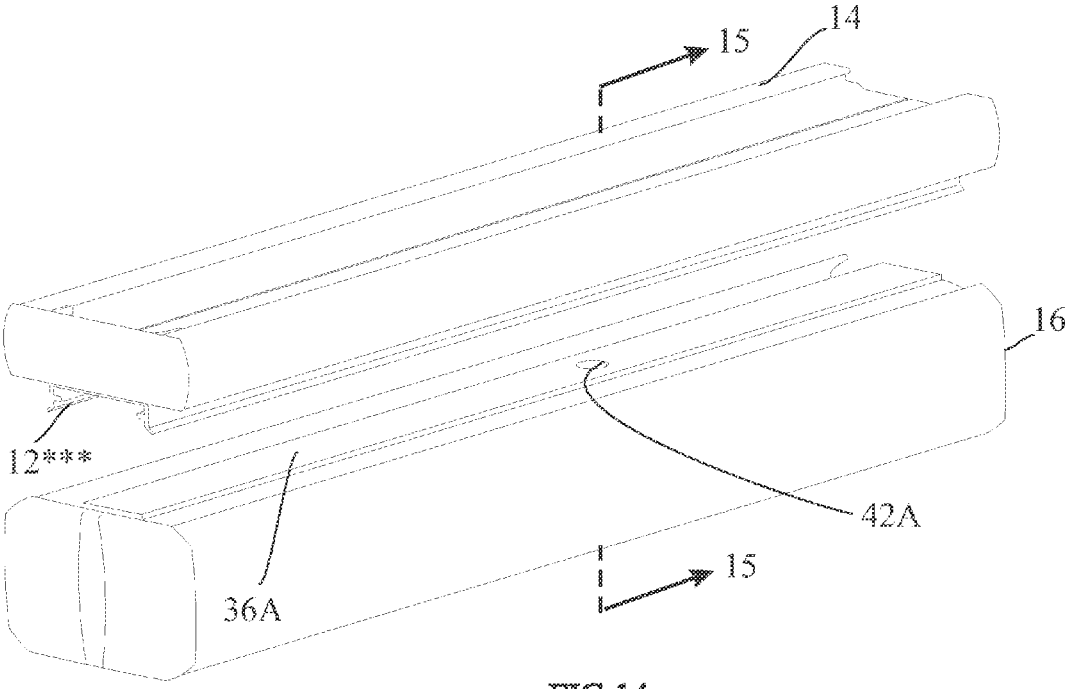
FIG. 14 is a perspective view, similar to FIG. 10, but with a magnetic strip and a magnetically-attracted strip.
Figure 15:
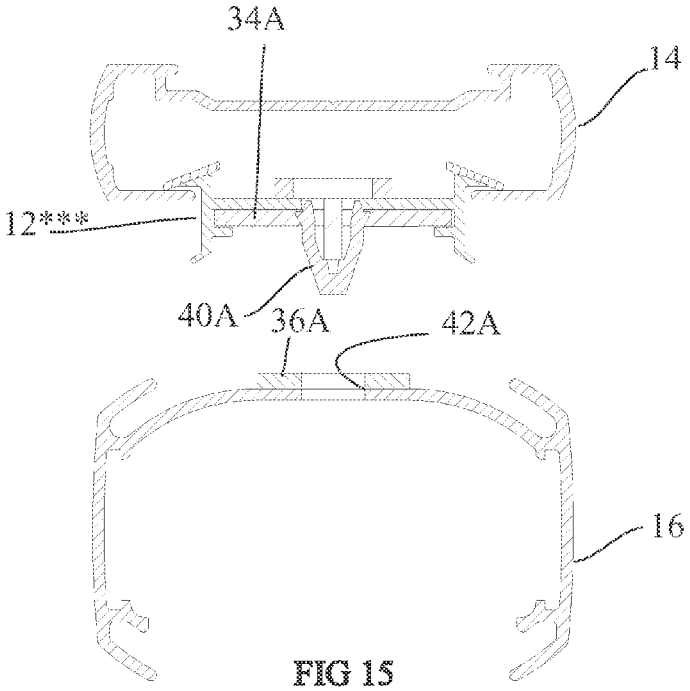
FIG. 15 is a section view along line 15-15 of FIG. 14.

FIGS. 14 and 15 show an alternative embodiment, in which the magnetically-attracted strip 34A extends the full length of the light-blocking element 12*, and the magnet 36A is a strip that extends the full length of the movable rail 16. In this embodiment, there is an opening 42A through the magnetic strip 36A and through the top surface of the movable rail 16, and a tapered alignment peg 40A extends through the strips 34A, 36A to help align the movable rail 16 with the head rail 14 as they come together.

Figure 20:
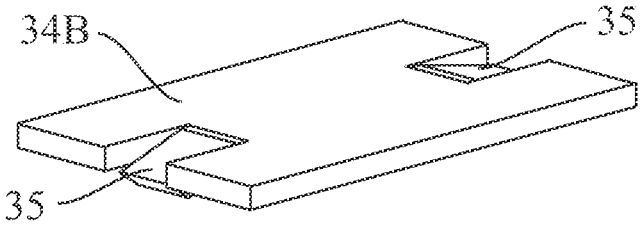
FIG. 20 is an alternative magnetically attracted strip.
Figure 21:
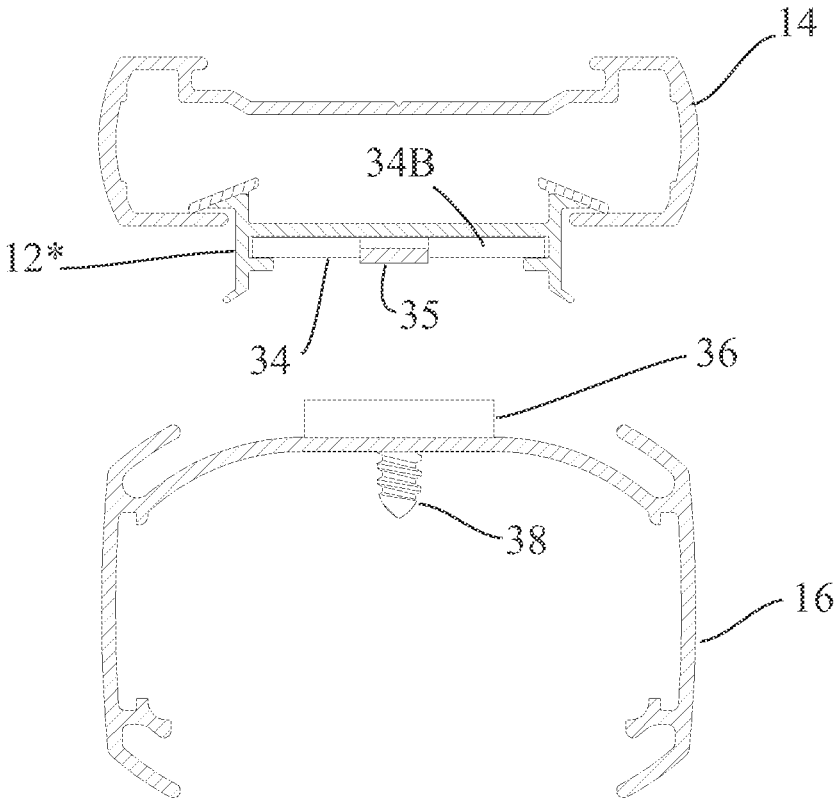
FIG. 21 is similar to the view in FIG. 11, but using the strip of FIG. 20.
Figure 22:
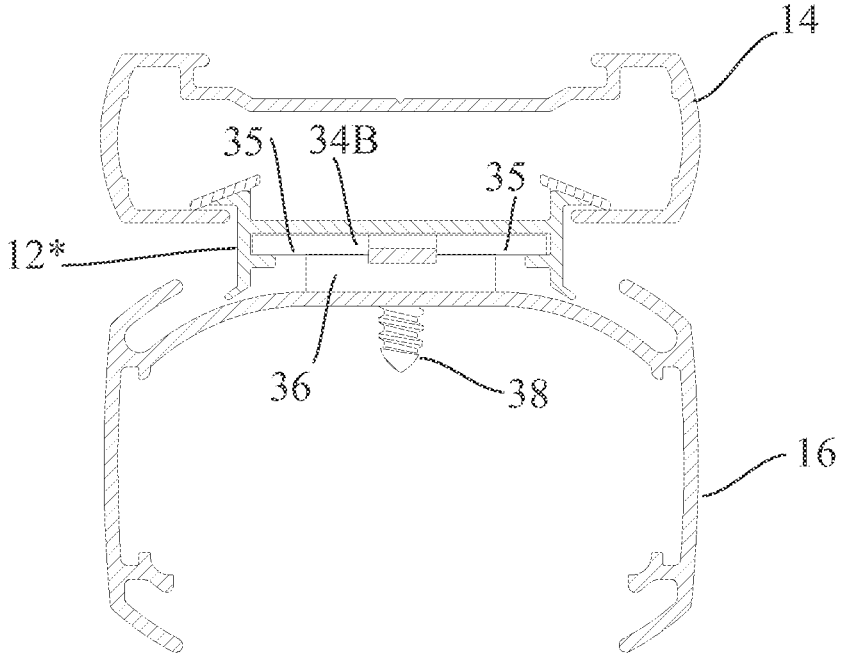
FIG. 22 is similar to the view in FIG. 21, but with the movable rail 16 moved upward until it contacts the light block element, yet before the movable rail lifts the light block element.

FIGS. 20-22 show another alternative embodiment, similar to the embodiment of FIGS. 10 and 11, but with the magnetically-attracted strip 34B having left and right downwardly-bent tabs 35, which extend at an angle so they are wider at the bottom and narrower at the top in order to surround and guide the left and right edges of the magnet 36 to the correct position and help align the movable rail 16 with the head rail 14 as the movable rail 16 moves upwardly toward the head rail 14.

While the embodiments described above show several means for covering the gap between the head rail 14 and the intermediate movable rail 16, various other mechanisms could be used to accomplish this goal. For example, hook-and-loop fasteners may be used instead of, or in addition to, the magnets to detachably secure the intermediate movable rail to the light-blocking element and provide support for the intermediate movable rail to alleviate bowing, sagging, deflection or distortion of the intermediate movable rail. Also, while this embodiment shows a movable bottom rail 18, the bottom rail 18 could be fixed.

While the embodiments described above show means for covering a horizontally-oriented gap, the same mechanism could be used for covering other gaps in architectural openings, including vertically-oriented gaps. In the case of a vertically-oriented gap, the mechanism would be rotated ninety-degrees from what has been shown here, and a spring could be provided to take the place of gravity in biasing the light-blocking element toward the movable rail. In that case, the relative positions of the elements of the mechanism would remain the same as in the embodiments shown here.

While the foregoing description and drawings represent exemplary embodiments of the present invention, it will be understood that various additions, modifications, and substitutions may be made therein without departing from the spirit and scope of the present invention or the principles thereof. For instance, it will be clear to those skilled in the art that the present invention may be embodied in other specific forms, structures, arrangements, proportions, and with other elements, materials, components, and otherwise, such as may be particularly adapted to specific environments and operative requirements, without departing from the spirit or essential characteristics thereof. While the disclosure is presented in terms of embodiments, it should be appreciated that the various separate features of the present invention need not all be present in order to achieve at least some of the desired characteristics and/or benefits of the present invention or such individual features. It will be appreciated that various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations, and features described with respect to one embodiment typically may be applied to another embodiment, whether or not explicitly indicated. Accordingly, individual features of any embodiment may be used and can be claimed separately or in combination with features of that embodiment or any other embodiment. Moreover, elements shown as integrally formed may be constructed of multiple parts or elements shown as multiple parts may be integrally formed, the operation of elements may be reversed or otherwise varied, the size or dimensions of the elements may be varied. Therefore, the present disclosure is not limited to only the embodiments specifically described herein. The presently disclosed embodiments are therefore to be considered in all respects as illustrative and not restrictive, the scope of the invention being indicated by the appended claims, and not limited to the foregoing description.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A covering for an architectural opening, comprising:

an elongated first rail extending in a left-to-right direction and defining an elongated bottom-facing opening extending in the left-to-right direction;

a movable rail adjacent to said elongated first rail, said movable rail being movable from an uppermost position to a lower position;

an extendable covering secured to said movable rail, said extendable covering extending and retracting as said movable rail moves toward and away from said elongated first rail;

an elongated light blocking element received in said elongated first rail, said elongated light-blocking element defining front and rear wings located inside said first rail; a central body portion beneath said front and rear wings, said central body portion extending through said bottom-facing opening; and a lower contact portion extending below said central body portion;

said light-blocking element being movable from a suspended position at a first elevation, in which said light-blocking element is supported by and suspended from said first rail, with said front and rear wings resting on said first rail, to a raised position at a second elevation, higher than the first elevation, in which said lower contact portion of said light-blocking element rests on said movable rail so that said movable rail supports said light blocking element.

2. A covering for an architectural opening as recited in claim 1, wherein:

said light-blocking element is in the suspended position when said movable rail is in the lower position, spaced away from said light-blocking element; and said light-blocking element is in the raised position when said movable rail is in the uppermost position.

3. A covering for an architectural opening as recited in claim 2, and further comprising a magnet on one of said light-blocking element or said movable rail., and a corresponding magnetically-attracted material on the other of said light-blocking element or said movable rail;

wherein said magnet and said magnetically-attracted material are placed such that they are magnetically attracted to each other when said movable rail is in said uppermost position.

4. A covering for an architectural opening as recited in claim 3, and further comprising an alignment peg on one of said light-blocking element or said movable rail, and a corresponding alignment opening on the other of said light-blocking element or said movable rail;

wherein said alignment peg and said alignment opening are placed such that said alignment peg enters said alignment opening when said movable rail is in said uppermost position.

5. A covering for an architectural opening as recited in claim 2, wherein said lower contact portion of said elongated light blocking element is made from a lower durometer material than said central body portion.

6. A covering for an architectural opening as recited in claim 5, wherein at least a portion of said wings is made of a lower durometer material than said central body portion.

7. A covering for an architectural opening as recited in claim 5, and further comprising a magnet on one of said light-blocking element or said movable rail, and a corresponding magnetically-attracted material on the other of said light-blocking element or said movable rail;

wherein said magnet and said magnetically-attracted material are placed such that they are magnetically attracted to each other when said movable rail is in said uppermost position.

8. A covering for an architectural opening as recited in claim 7, and further comprising a magnet on one of said light-blocking element or said movable rail, and a corresponding magnetically-attracted material on the other of said light-blocking element or said movable rail;

wherein said magnet and said magnetically-attracted material are placed such that they are magnetically attracted to each other when said movable rail is in said uppermost position.

9. A covering for an architectural opening as recited in claim 8, and further comprising an alignment peg on one of said light-blocking element or said movable rail, and a corresponding alignment opening on the other of said light-blocking element or said movable rail;

wherein said alignment peg and said alignment opening are placed such that said peg enters said opening when said movable rail is in said uppermost position.

10. A covering for an architectural opening as recited in claim 2, wherein at least a portion of said wings is made of a lower durometer material than said central body portion.

11. A covering for an architectural opening as recited in claim 10, and further comprising a magnet on one of said light-blocking element or said movable rail, and a corresponding magnetically-attracted material on the other of said light-blocking element or said movable rail;

wherein said magnet and said magnetically-attracted material are placed such that they are magnetically attracted to each other when said movable rail is in said uppermost position.

12. A covering for an architectural opening as recited in claim 11, and further comprising an alignment peg on one of said light-blocking element or said movable rail, and a corresponding alignment opening on the other of said light-blocking element or said movable rail;

wherein said alignment peg and said alignment opening are placed such that the peg enters the opening when said movable rail is in said uppermost position.

13. A covering for an architectural opening, comprising:

an elongated first rail including a front side and an opposed back side extending in a lengthwise direction of said first rail, said first rail further including a first side extending between said front and back sides of said first rail;

a movable rail movable towards and away from said first rail including a front side and an opposed back side extending in a lengthwise direction of said movable rail, said movable rail further including a second side extending between said front and back sides of said movable rail, said second side of said movable rail facing said first side of said first rail;

an extendable covering secured to said movable rail, said extendable covering extending and retracting as said movable rail moves towards and away from said first rail; and a light blocking element movably coupled to and recessed into one of said first rail or sad movable rail between said front and back sides of said one of said first rail or said movable rail;

wherein when said movable rail moves to a position closest to said first rail, said light blocking element enters into a recess defined between said front and back sides of the other of said first rail or said movable rail and thereby is recessed into both said first rail and said movable rail.

14. A covering for an architectural opening as recited in claim 13, wherein said light-blocking element defines a central body, front and rear wings located at one end of said central body for positioning within said one of said first rail or said movable rail, and a contact portion extending from a second end of said central body portion.

15. A covering for an architectural opening as recited in claim 13, wherein said light blocking element floats relative to said one of said first rail or said movable rail while being retained by said one of said first rail or said movable rail.

16. A covering for an architectural opening as recited in claim 13, wherein said light blocking element is movably coupled to and recessed into an open-ended cavity defined through a corresponding one of said first side or said second side of said one of said first rail or said movable rail.

17. A covering for an architectural opening as recited in claim 13, wherein said recess is defined along a corresponding one of said first side or said second side of the other of said first rail or said movable rail between said front and second sides of the other of said first rail or said second rail between.

18. A covering for an architectural opening as recited in claim 13, wherein said light blocking element contacts a corresponding one of said first side or said second side of the other of said first rail or said movable rail when said movable rail moves to said position closest to said first rail.

19. A covering for an architectural opening, comprising:

an elongated first rail;

a movable rail movable towards and away from said first rail;

an extendable covering secured to said movable rail, said extendable covering extending and retracting as said movable rail moves towards and away from said first rail; and a light blocking element movably coupled to and recessed into one of said first and or said movable rail;

wherein:

when said movable rail moves to a position closest to said first rail, said light blocking element enters into a recess in the other of said first rail or said movable rail and thereby is recessed into both said first rail and said movable rail; and said light blocking element is configured to float relative to said one of said first rail or said movable rail while being retained. by said one of said first rail or said movable rail.

20. A covering for an architectural opening as recited in claim 19, wherein said light-blocking element defines a central body, front and rear wings located at one end of said central body for positioning within said one of said first rail or said movable rail, and a contact portion extending from a second end of said central body portion.

21. A covering for an architectural opening, comprising:

an elongated first rail;

a movable rail movable towards and away from said first rail;

an extendable covering secured to said movable rail, said extendable covering extending and retracting as said movable rail moves towards and away from said first rail; and a light blocking element movably coupled to and recessed into one of said first and or said movable rail;

wherein:

when said movable rail moves to a position closest to said first rail, said light blocking element extends between said first rail and said movable rail; and said light blocking element is configured to float relative to said one of said first rail or said movable rail while being retained by said one of said first rail or said movable rail.

22. A covering for an architectural opening as recited in claim 21, wherein said light blocking element defines a central body, front and rear wings located at one end of said central body for positioning within said one of said first rail or said movable rail, and a contact portion extending from a second end of said central body portion.

* * * * *